United States Patent [19]

Finn

[11] 4,049,035

[45] Sept. 20, 1977

[54] CURRENCY BILL BILLFOLD FILE

[76] Inventor: Donald J. Finn, 5100 N. Ocean Blvd., Sea Ranch Club No. 712, Fort Lauderdale, Fla. 33308

[21] Appl. No.: 762,262

[22] Filed: Jan. 25, 1977

[51] Int. Cl.[2] ..... A45C 1/06

[52] U.S. Cl. ..... 150/38; 150/35

[58] Field of Search ..... 150/38, 35

[56] References Cited

U.S. PATENT DOCUMENTS

| | | | |
|---|---|---|---|
| 1,749,020 | 3/1930 | Curry | 150/38 |
| 1,909,809 | 5/1933 | Buxton | 150/38 |
| 2,249,558 | 7/1941 | Green | 150/38 |
| 2,315,702 | 4/1943 | Herbener | 150/38 |
| 2,397,366 | 3/1946 | Ogden | 150/38 |
| 2,422,432 | 6/1947 | Miller | 150/38 |
| 2,439,731 | 4/1948 | Hawes | 150/38 |

*Primary Examiner*—Ro E. Hart

*Attorney, Agent, or Firm*—Hiram A. Sturges

[57] ABSTRACT

A billfold file for storing currency bills in a billfold, the file being attached or unattached thereto, for quick, accurate filing. A master plate adapted to bend with the billfold and having left and right retainers off-set from one side thereof and providing edges around which the inwardly turned ends of a plurality of parallel panels are disposed, the panels being semi-rigid and adapted to be disposed with broad bill engaging central portions arranged in parallelism with the master plate for receiving currency bills therebetween, the panels bearing bill denomination indicia.

15 Claims, 5 Drawing Figures

CURRENCY BILL BILLFOLD FILE

BACKGROUND OF THE INVENTION

Errors commonly occur when persons in a hurry make change involving currency bills stored in their billfold. In addition to hurrying there are many distractions that tend to cause mistakes to be made. This problem is particularly great for those people who do business from their billfold all day long because of many dozens of transactions.

I had first thought it might be substantially impossible to design a billfold file so that it would be stiff enough and strong enough to hold its position in the billfold with constant use and yet have parts that are thin enough so as not to swell out a billfold making it so thick that the file would not be accepted by users but I have found by long experiment that it is possible to have the parts of such a file made of materials and of thicknesses, spacings and shapes that can accomplish the answer to those problems and to provide a compact, effective billfold file for durability and long use and separating the different bills of different denominations effectively so they can be easily and quickly found behind index tabs, which latter are disposed within the outlines of the billfold so that they will not be damaged during use.

The problem of a billfold file suitable for billfolds of the one fold type is particularly a problem because in a one fold billfold there is a folding that occurs right at the center which is the only place where on can effectively attach such a file to the billfold in cases where attachment is desired. Attachment is not necessary in all cases as I have found that friction alone will hold a file in place very well.

A fixing of panels together is one way of making a unitary billfold file, but this will not work in a single fold billfold because the only place where panels can be attached together is at the center of a panel lengthwise which is the exact place where bending is desired whereby attachment of panels together at that place would not work.

Consequently, I engaged in long research and developement and conceived the idea of having a billfold file in which the panels are loosely secured to a master plate and are not secured together at the center lengthwise of the panels at all. With my new concept of this invention they are free to move with respect to each other as the billfold is opened and closed, unbent and bent.

The new concept involves having a master plate to which the panels are loosely secured but in a manner such that they stay in place with ends bent around the retainer edges of retainer portions of a master plate which are offset from the remainder of the master plate itself.

SUMMARY OF THE INVENTION

A billfold file for storing currency bills in a billfold, the file having a master plate adapted to bend with the billfold and substantially filling the billfold, the master plate having left and right retainers off-set from one side of the master plate, the retainers having retainer edges off-set inwardly from the ends of the master plate, and a plurality of parallel panels disposed one inside the other, each panel having a substantially U-shaped end portion, extending around the retainer edge so that each panel is provided with a right and left positioning end portion disposed in lapping relationship with the retainer, which provides a retainer edge, each panel being free to move with respect to other panels somewhat, as the billfold containing the file is bent and unbent, closed and open.

DESCRIPTION OF THE PREFERRED EMBODIMENT

Figure 1:
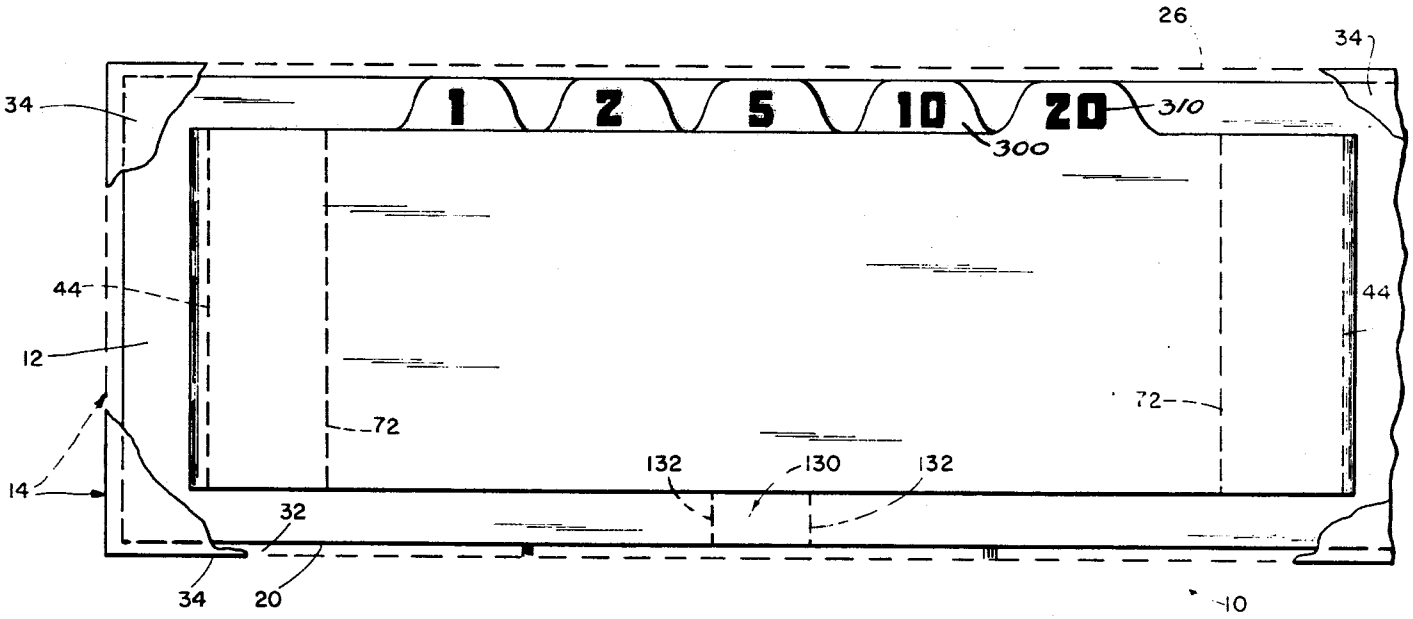
FIG. 1 is a frontal elevation of a billfold containing the billfold file of this invention with most of the forward or inner side of the billfold broken away and the remainder of the billfold shown in dotted lines. The boundaries of an area occupied by grooves being diagrammatically illustrated by dotted lines.

A billfold and billfold file assembly is generally indicated at 10 in FIG. 1, and comprises a billfold file generally indicated at 12 for receiving currency bills, not shown.

The file 12 is disposed inside a billfold 14. The billfold file 12 comprises a master plate 20, the master plate being formed of semi-rigid bendable material of sufficient rigidity as to maintain itself upright when disposed inside the billfold 14 and during times when the billfold is held with its open side 26 upward with the master plate 20 and the entire file 12 disposed between the forward side 32 and the rearward side 34 of the billfold 14.

The master plate 20 is formed of a thin sheet of material which is preferably of the kind called "living plastic" and identified as PRO-FAX 6723 which is a semi-rigid polypropylene of a thickness of between 0.30 and 0.20 inch.

Figure 2:
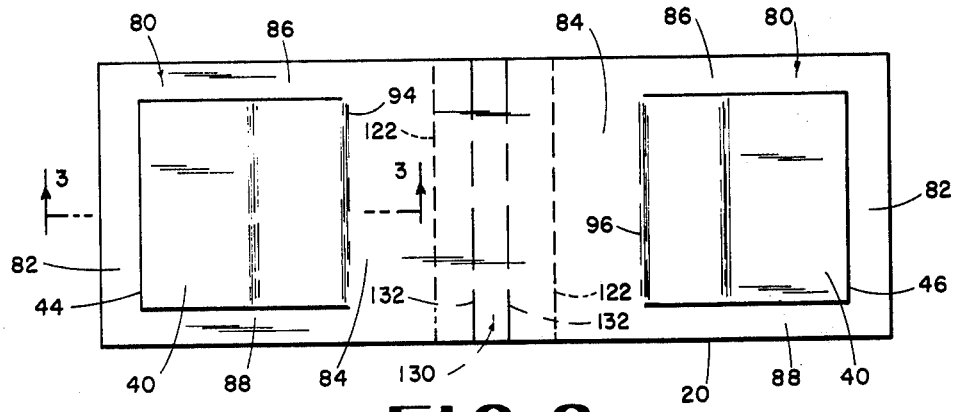
FIG. 2 is a frontal elevation of the master plate portion of the billfold file of this invention as it would be seen from its forward side such as would face the inner side of a billfold, the boundaries of an area occupied by grooves extending transversely of the master plate being diagrammatically illustrated in dotted lines, other dotted lines indicating the general position diagrammatically of two areas occupied by glue on the outer or rearward side of the master plate on preferably either the right or the left side of the center lengthwise of the master plate. The glue and the grooves are both disposed on the outer or rearward side of the master plate.
Figure 3:
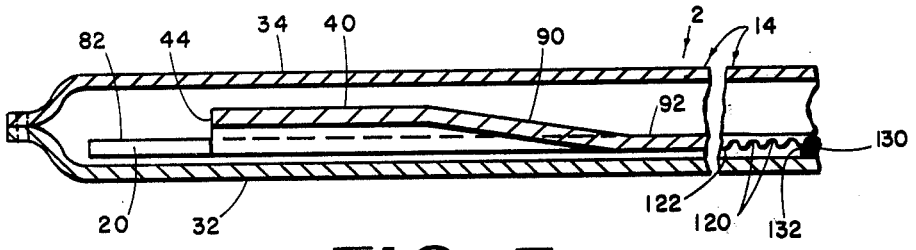
FIG. 3 is a sectional view taken along the line 3—3 of FIG. 2, generally, although the section is extended so as to extend into the area occupied by the grooves mentioned in connection with FIG. 1.

The invention further comprises left and right retainers 40 attached to the master plate 20, as best seen in FIGS. 2 and 3. Each retainer 40 is offset from the master plate 20 a distance of approximately 0.130 inch, as indicated by the arrow 42 in FIG. 3. The retainers 40 have left and right retainer edges 44 and 46 respectively which extend transversely to the left to right elongation of the master plate 20.

Figure 5:
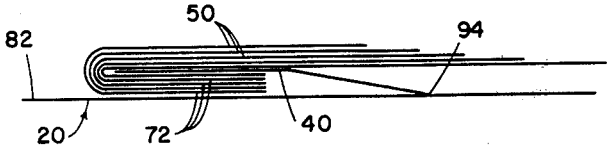
FIG. 5 is a bottom plan view made diagrammatically of one end of a master plate used to illustrate how both ends are made, the view being a bottom plan view of the left end of the master plate of FIG. 2, but shown with the left end of panels assembled thereon, the remainder of the panels and master plate not being shown.

A plurality of substantially parallel panels 50 are seen best in FIG. 5 in total. The panels 50 are each formed of flexible material, preferably the thermoplastic material called "PROFAX" SB-184 flexible polypropylene. Each of the panels 50 can be of the same thickness, preferably 0.010 thickness as the others. The panels 50 fit one lapping the other at successively greater distances from the master plate 20, as best seen in FIG. 5 and with each panel having a left and right positioning end portion 72.

The panels are sufficiently rigid as to tend to remain with their central bill-engaging portions 74 disposed substantially in vertical planes, respectively, during times when a billfold containing the file 12 is held in unfolded position with its open end upward.

The bill-engaging portions 74 of the panels 50 are each of a size for totally receiving thereagainst a conventional currency bill, such as the one-dollar bill, for example, disposed in parallelism with the respective bill-engaging portion 74.

Each of the panels 50 has its left and right positioning end portions disposed in parallelism with respective left or right positioning end portions 72 of the respective bill-engaging portion 74 of the same panel. Each of the panels 50 has a left and right end interconnecting portion 76, best seen in FIG. 4, respectively connecting the respective bill-engaging portion 74 with the respective left and right positioning end portions 72 thereof.

The positioning end portions 72 are disposed on the master plate 20 side of the off-set retainers 40, respectively, as best seen in FIG. 5, in which a left end retaininer 40 is shown.

Each retainer 40 is connected to the central portion 92 of the master plate by an inclined connector 90 which is of one piece with respect to the retainer 40, and the remainder of the master plate 20. The inclined connectors 90 extend from the off-set retainers 40 inwardly toward the planar central portion 92 of the masterplate where they join with a inner surrounding portion 84, which latter is one of four portions which surround each retainer and inclined connector 90, such surrounding portions being parts of a surrounding section 80, seen in FIG. 2, and such portions being end portions 82, inner portions 84, upper surrounding portions 86 and lower surrounding portions 88.

Each retainer 40 and its inclined connector 90 are both connected substantially entirely along the upper and lower edges of each retainer 40 and its connector 90 to the master plate.

The retainer-surrounding sections 80 are substantially planar and disposed in the smae plane with the central portion 92 of a master plate.

Each inclined connector 90 joins the central portion 92 of the master plate along a line 94, seen in FIG. 5, the line 94 extending transversely to the length of the master plate.

In FIG. 1 and FIG. 2 a strip of glue is seen at 130 extending between edges 132 thereof, which extend in parallelism transversely of the length of the master plate 20, the glue area 130 being on the rearward or outer side of the billfold 14, such outward side being seen at 32 in FIG. 3, the outer side of the master plate 20 being that side thereof which is opposite to the side on which the retainers 40 are disposed, the said opposite side being recognizable in FIG. 3 by scoring of the central section 92 of the master plate with a plurality of vertical grooves equi-distantly spaced apart and extending between lines 122 see in FIG. 2.

The glue 130 extends a lesser distance as measured lengthwise of the billfold than is the area occupied by the grooves 120, as seen in FIGS. 2 and 3.

The thickness of the master plate 20 at each groove 120 of FIG. 3 in 0.10 inch. The grooves are preferably ⅛ inch apart and extend between the lines 122 of FIG. 2, which are 1 inch apart. The purpose of the grooves 120 is to cause the master plate 20 to be very easy to bend at its center so as to bend with the billfold and thereby work in an excellent fashion with a billfold of the type having a single central fold midway between the lines 132 of FIG. 2 and parallel thereto.

It is to be understood that the glue 130 is optional, since it has been found that the billfold file will stay in place in a billfold from friction alone. The glue 130 does, however, serve to attach the billfold file 12 permanently to a billfold by attachment to the inner side to the rearward or outer side 32 of the billfold.

Figure 4:
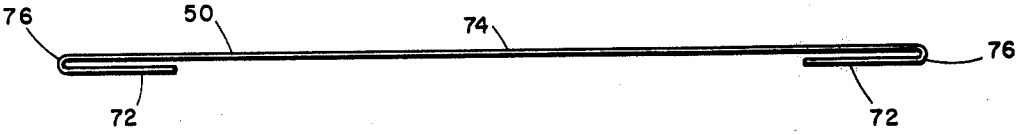
FIG. 4 is a bottom plan view of one of the panels of the billfold file.

Each of the panels 50 are sufficiently stiff to hold the shapes above described, and shown in FIGS. 4 and 5, even though they are very thin and scarcely increase the thickness of a total billfold assembly at all. They are also so flexible as to be very easily bent as the billfold is folded.

Each panel 50 has an index tab 300 on its upper edge receiving thereon a numerical indicia 310, indicating the denomination of currency bills intended to be disposed in storage behind the particular panel 50 on which a given indicia is printed. Each tab is off-set with respect to other tabs of the other panels, as best seen in FIG. 1, so that all tabs are visible at once. The indicia 310 on each tab face the inner or forward side 34 of the billfold. The total size of the master plate 12 is such as to be completely received within the outlines of the billfold 14, and the tabs 300 are so constructed as not to project beyond the outlines of the master plate 20 when the master plate 20 looked at in side elevation.

I have discovered that when the left and right positioning end portions 72 of each panel 50 extend back upon and lap the remainder of the panel a distance of 1 inch that that is sufficient for causing the panels to stay in place during use. For that reason each retainer 40 is preferably 1 inch in width as measured lengthwise of the master plate and the total distance from a retainer edge 44 or 46 to the inner end of a respective connector 90 at the line 92 of FIG. 3 is 2½ inches in effective models.

The distance between retainer edges 44 and 46 in successful models has been 7½ inches and the total length of the master plate 8½ inches with the vertical height of a retainer 40 being 2 ⅜ inches and the total vertical height of the master plate being 3 ⅛ inches. The length of the innermost one of the panels 50, which latter is the panel bearing the indicia 1 for indicating one-dollar bills is 7½ inches in length plus 0.020, so as to be slightly longer than the distance between the retainer edges 44 and 46.

It will be understood that dimensions can vary, however, and that billfolds are of different sizes. In some countries currency is of different sizes.

The billfold file 12 of this invention can be used with single fold billfolds or two fold billfolds, all within the principles set forth herein, although some dimensional changes would be needed to fit some of the billfolds, particularly some of two fold billfolds.

It is to be particularly observed that each of the panels 50 is slightly longer than the next innermost panel 50, and that the spacing of the positioning end portion 72 of each panel with respect to the planar bill-engaging portion 74 of the panel is a greater spacing proportionally for each panel than is the spacing for any panel disposed inwardly of a given panel so as to achieve the overlapping configuration shown in FIG. 5.

The billfold 14 has its inner and outer panels 34 and 32 connected together around the bottom and end edges thereof in the usual manner found in billfolds with the upper edges thereof spaced apart for access.

The master plate can be of different thicknesses than described, for example, it could be 0.015 inch also in thickness, particularly when the plastic used has stiffener in it to make it 50% more stiff, even though the basic material is the same as described.

Contrary to anything stated previously glue is not used at the very center between the ends of the master plate, but is instead used, if used at all, in areas disposed alongside the center where there is no bending such as along the lines 132, but in general, not between the lines 132 of FIG. 2. This is in the case of the single fold billfold gluing. Where the billfold is of the double fold type, it is important that there be two scored areas extending transversely of the length of the master plate, one at each place of bending of the billfold.

For a two fold billfold use, then the master plate should be designed with its inclined connector portions 90 meeting the general plane of the master plate along the line 92 of FIG. 3 on dimensions such that the line 92 is ¼ inch farther toward the respective outer edge of the end of the billfold which is adjacent. In gluing a tri-fold billfold to a master plate the glue can be placed any where except at a bend. It is best to glue only one side of the master plate to a bill fold.

I claim:

1. A billfold file for receiving currency bills, said file being for carrying inside a billfold for quick, easy and accurate storage and removal of bills, said file comprising: a master plate, said master plate being formed of semi-rigid bendable material of sufficient rigidity as to maintain itself upright when in a billfold during times when said billfold is held with its open side upward containing said master plate, said master plate being a thin sheet of material, left and right retainers attached to said master plate and protruding from said master plate and each disposed offset from said master plate, said left and right retainers respectively having left and right retainer edges extending transversely to said elongation of said master plate, and a plurality of substantially parallel panels of flexible material, said panels having a central bill-engaging portion for engaging currency bills disposed between adjacent panels, said panels being sufficiently rigid as to tend to remain with their central bill-engaging portions disposed substantially in vertical planes respectively during times when a billfold containing said file is held unfolded with its open end upward, said bill-engaging portions of said panels each being of a size for totally receiving there against a conventional currency bill disposed in parallelism therewith, each of said panels having left and right positioning end portions disposed in parallelism with respective left and right end portions of said bill engaging portions thereof, each of said panels having a left end and a right end inter-connection portion respectively interconnecting the said bill engaging portion with the left and right positioning end portion thereof, said positioning end portions being disposed on the master plate side of said off-set retainers respectively, said inter-connecting portions extending around said retainer edges respectively, said panels each being sufficiently taut between its two inter-connecting portions and said panels each being formed of sufficiently rigid material that the inter-connecting portions of each panel in normal use each hold a position extending around the respective retainer edges thereof, the left and right interconnection portions of said panels being disposed at progressively greater distances from respective retainer edges, said panels being disposed one inside another with the space between the positioning end portion and the bill-engaging portion of each respective panel being greater than the equivalent spacing for any of the panels disposed inwardly thereof.

2. The billfold file of claim 1 in which said retainers are each surrounded by portions of said master plate, said retainers each being secured to said master plate substantially entirely along the upper and lower edges of each retainer.

3. The billfold file of claim 1 in which said retainers are each surrounded by portions of said master plate, said retainers each being secured to said master plate substantially entirely along the upper and lower edges of each retainer, said retainers being secured to said master plate at the left end of said left retainer and at the right end of said right retainer respectively.

4. The billfold file of claim 1 in which said retainers are formed of one piece of material with said master plate.

5. The billfold file of claim 1 having said retainers secured to said master plate at the left end of said right retainer and at the left end of said right retainer respectively.

6. The billfold file of claim 1 having said master plate having left and right retainer-surrounding sections surrounding its left and right retainers respectively, said retainer-surrounding sections each being substantially planar, said left and right retainers as seen in top plan view generally inclining from the plane of the respective left and right retainer-surrounding master plate section outwardly from said master plate toward said left and right retainer edges respectively.

7. The billfold file of claim 1 in which said panels are each substantially of oblong rectangular shape in side elevation.

8. The billfold file of claim 1 in which each of said panels has an index tab extending upwardly therefrom, currency bill denomination indicia means on each of said tabs, the number indicia means on each tab being of a different number.

9. The billfold file of claim 1 in which said master plate is provided with a plurality of parallel linear areas of lesser thickness than the remainder of the respective master plate, said linear areas of lesser thickness extending transversely of the length of the master plate at a place where it is desired that the master plate bend more freely.

10. The billfold file of claim 9 in which said parallel linear areas of lesser thickness are disposed at a center between the ends of said master plate.

11. The billfold file of claim 1 in which said master plate is formed of a material having the relative rigidity and flexibility of the thermoplastic material known as PROFAX-6723 polypropylene so as to be semirigid in which the thickness of said master plate is between 0.030 and 0.020 inch generally but is provided with parallel linear areas of lesser thickness than the remainder of the master plate, said parallel linear areas of lesser thickness extending transversely of the length of the master plate a right angle to the length of the master plate at a place where it is desired that the master plate bend freely, such parallel linear areas of lesser thickness having approximately the thickness of 0.010 inch and being approximately ⅛ inch apart over approximately a 1 inch width extending lengthwise of the master plate.

12. The billfold file of claim 1 in which said retainer edges are off-set from said master plate a distance of approximately 0.70 inch.

13. The billfold file of claim 1 in combination with a billfold in which said billfold file is disposed, said billfold having an open upper side.

14. The billfold file of claim 13 in which said master plate is secured to the inner side of the outer wall of said billfold at approximately the center between the ends of said master plate.

15. The billfold file of claim 1 in which said panels are each formed of a material of substantially the flexiblity of the thermoplastic material known as PROFAX-SB-814 flexible polypropylene of approximately 0.010 inch thickness.

* * * * *